United States Patent [19]

Quebe

[11] 4,202,410

[45] May 13, 1980

[54] SEAL TESTING ARRANGEMENT FOR WELLHEADS

[75] Inventor: Herbert O. Quebe, Shreveport, La.

[73] Assignee: W-K-M Wellhead Systems, Inc., Shreveport, La.

[21] Appl. No.: 15,990

[22] Filed: Feb. 28, 1979

[51] Int. Cl.[2] ..... E21B 33/03

[52] U.S. Cl. ..... 166/88; 166/97

[58] Field of Search ..... 166/88, 90, 97, 95, 166/84, 75 R, 250, 336, 337; 285/140

[56] References Cited

U.S. PATENT DOCUMENTS

| | | | |
|---|---|---|---|
| 3,155,401 | 11/1964 | Musolf | 166/88 X |
| 3,353,596 | 11/1967 | Brown | 166/337 |
| 3,438,654 | 4/1969 | Jackson, Jr. et al. | 166/88 X |
| 3,478,822 | 11/1969 | Holbert, Jr. et al. | 166/88 |
| 4,071,085 | 1/1978 | Grable et al. | 166/84 |

*Primary Examiner*—Stephen J. Novosad
*Attorney, Agent, or Firm*—Eugene N. Riddle

[57] ABSTRACT

An arrangement for testing a metal seal at a wellhead joint between a tubing head adapter for a tubing hanger. An inner sleeve is installed at the joint and extends within the adapter and within the hanger at a location spaced inwardly of the metal seal to form a pressure chamber therebetween for receiving test fluid. The fluid is delivered through a passage in the adapter to test the seal for leakage from the inside of the joint. Another test chamber is formed between the metal seal and a secondary seal located between flanges of the tubing head and adapter. A second test passage is formed in the adapter to direct test fluid to the second chamber for seal testing purposes.

11 Claims, 2 Drawing Figures

SEAL TESTING ARRANGEMENT FOR WELLHEADS

BACKGROUND OF THE INVENTION

This invention relates generally to wellhead equipment and deals more particularly with an arrangement for testing a metal seal incorporated in a wellhead assembly.

During completion of oil and gas wells, the wellhead components are tightly sealed against one another to prevent leakage of the well fluids. Although the seals are normally tested for leakage before the well is brought into production, such testing is typically carried out from the outside of the seals. Even if the seals test successfully from the outside, they may nevertheless leak considerably when exposed to fluid pressure from the inside, particularly in high pressure wells. As a result, many faulty seals are not detected until the well is in actual production. This circumstance not only presents a serious safety hazard, but it also causes a significant loss of well fluid and involves substantial expense and delay due to the need to disassemble the wellhead for replacement of the defective seal or seals. These and other related problems have been compounded in recent years by the trend toward deeper wells in which there is an increased likelihood of seal failure because of the high pressures that are encountered.

SUMMARY OF THE INVENTION

The present invention has, as its primary object, the provision of a wellhead assembly having a metal seal ring which forms a high pressure seal between the tubing hanger and adapter flange and which may be tested for leakage from the inside to assure that it will not leak when subjected to pressure from well fluids. In accordance with the invention, the seal ring provides a tight metal-to-metal seal at a joint which is formed between the tubing hanger and the adapter flange which is mounted on top of the tubing head to receive the valves of the Christmas tree. A sleeve is mounted within the tubing hanger and the adapter flange and is sealed to each so as to provide a fluid-tight chanber inside of the metal seal ring. A test passage extends through the adapter flange to the test chamber and serves to deliver pressurized test fluid to the chamber for testing of the seal ring from inside of the joint. The sleeve is received in grooves formed inside of the hanger and adapter so that there are no abrupt changes in the size of the flow passage which receives the well fluids during production of the well.

BRIEF DESCRIPTION OF THE DRAWING

In the accompanying drawings which form part of the specification and are to read in conjunction therewith.

DETAILED DESCRIPTION OF THE INVENTION

Figure 1:
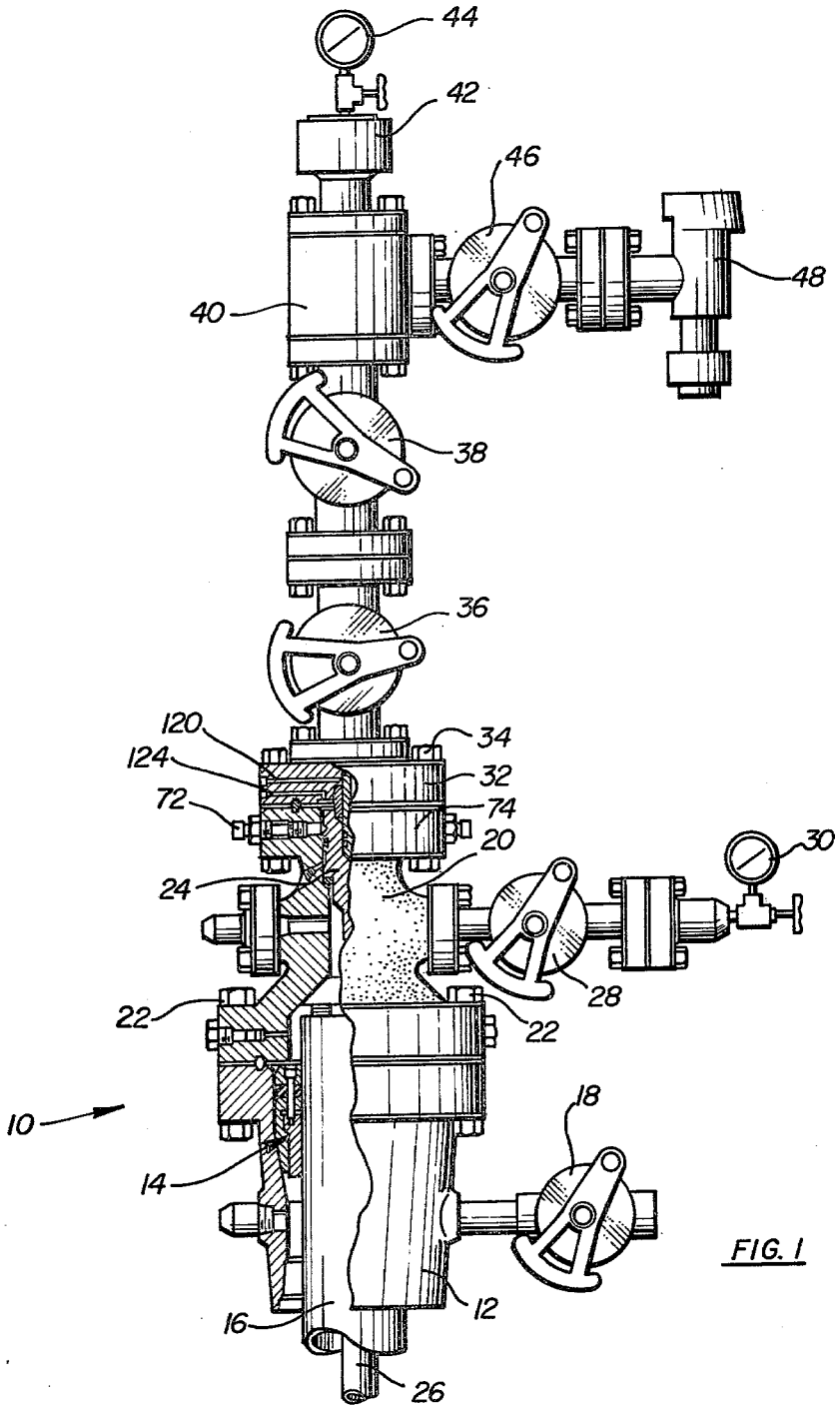
FIG. 1 is an elevational view of a wellhead and Christmas tree assembly which incorporates the metal seal ring and the seal testing arrangement of the present invention, with portions broken away for purposes of illustration.

Referring now to the drawings in more detail and initially to FIG. 1, numeral 10 generally designates a wellhead and Christmas tree assembly. The wellhead includes a casing head 12 which is adapted to be secured to the top end of a surface casing (not shown). A slip assembly 14 having suitable seals is mounted within casing head 12 and suspends a well casing 16 which extends downwardly into the well concentrically within the surface casing. The casing head 12 has a valve 18 which is connected with an outlet of the casing head to control the flow from the annular space between the surface casing and well casing 16.

A tubing head 20 is mounted on top of casing head 12, with mating flanges of the casing head and tubing head being secured together by bolts 22. Mounted within the bore of tubing head 20 is a tubing hanger 24 which will be described in more detail hereinafter. Tubing hanger 24 supports a string of tubing 26 which extends concentrically within casing 16 to receive the fluids produced by the well. A valve 28 is mounted to an outlet on the side of tubing head 20 to control the flow of fluid from the annular space between tubing 26 and casing 16. The outlet controlled by valve 28 is equipped with a pressure gauge 30 to provide an indication of the tubing head pressure.

An adapter flange 32 is bolted on top of tubing head 20 by bolts 34. A lower master valve 36 is mounted on top of flange 32 to control the flow from tubing 26. An upper master valve 38 is mounted on top of valve 36 and in turn receives a flow fitting 40 on its top end. A top connection 42 is mounted on top of fitting 40 and is equipped with a pressure gauge 44 which provides an indication of the tubing pressure. A wing valve 46 is mounted to the side of fitting 40 and is connected at its opposite end with a choke 48.

Figure 2:
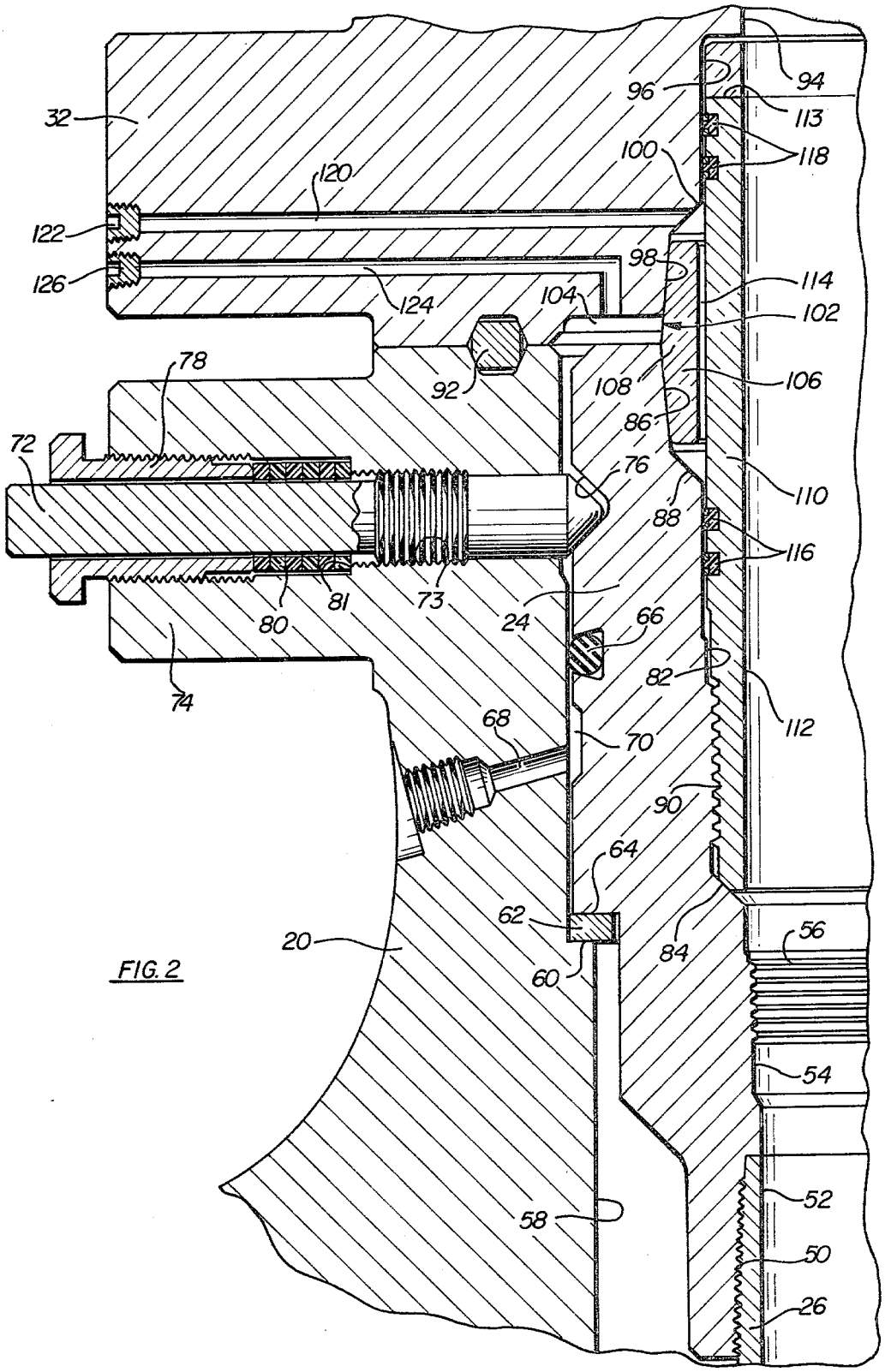
FIG. 2 is a fragmentary sectional view on an enlarged scale showing the tubing head and associated components of the wellhead assembly in the area of the seal ring and seal testing arrangement.

Referring now more particularly to FIG. 2, which illustrates the details of the present invention, the upper end of the production tubing 26 is threaded at 50 to the lower end of tubing hanger 24. A cylindrical inside surface 52 of tubing 26 mates with the cylindrical inner surface 54 of hanger 24 to provide a smooth flow transition from the tubing to the tubing hanger. Hanger 24 is internally threaded at 56 to receive a handling tool (not shown) which is used to set the tubing hanger.

Tubing hanger 24 is mounted in a central bore 58 of tubing head 20. Bore 58 presents an upwardly facing flat shoulder 60 which receives a seal ring 62 preferably formed of a metal such as stainless steel or a metarial having similar properties. Tubing hanger 24 has a downwardly facing shoulder 64 which rests on top of seal ring 62 in a manner to support the tubing hanger 24 within tubing head 20. Seal ring 62 is thereby compressed such that it forms a tight metal-to-metal seal with bore 58 and with the outer surface of tubing hanger 24. At a location spaced above seal ring 62, an annular seal 66 is carried in a groove formed in the outside surface of tubing hanger 24. Seal 66 is formed of elastomeric material which provides a seal between the tubing hanger and bore 58 of tubing head 20. A threaded test passage 68 which is normally plugged leads from the outside surface of tubing head 20 to an annular groove 70 formed on the outside surface of tubing hanger 24 at a location between seals 62 and 66. Pressurized test fluid may be forced through passage 68 to test seals 62 and 66 for leakage.

Tubing hanger 24 is held down by a plurality of hold-down screws 72 which are screwed into threaded openings 73 in a flange 74 formed integrally on the top end of tubing head 20. Each screw 72 has a conical tip which fits in a tapered annular groove 76 formed in the outer surface of tubing hanger 24. By engagement with the inclined lower surface of groove 76, screws 72 hold tubing hanger 24 down against any upward forces that may be exerted thereon. A packing gland 78 is threaded into flange 74 around the shank of each screw 72 to activate a packing set 80 which is compressed between gland 78 and a shoulder 81 to form a seal between screw 72 and the corresponding opening 73.

The cylindrical inside surface of tubing hanger 24 is provided with an annular groove 82 which extends from the top of the tubing hanger and terminates at a location above threads 56. The lower end of groove 82 is preferably in the form of a frusto-conical surface 84. A second annular groove 86 is formed within groove 82 at the top end of tubing hanger 24. Groove 86 terminates at its lower end in a frusto-conical surface 88 which is located well above internal screw threads 90 that are formed in hanger 24 near the bottom of groove 82.

Adapter flange 32 is mounted on top of flange 74 of the tubing head 20 and is sealed thereto by an elastomeric seal ring 92. Adapter flange 32 is a hollow member having a cylindrical bore 94 of substantially the same diameter as the inside surfaces 52 and 54 of tubing 26 and tubing hanger 24, respectively. An annular groove 96 is formed in the inside surface of adapter flange 32 and extends to the bottom thereof. Groove 96 is the same depth as groove 82 and is located directly above groove 82 to form an upward continuation thereof. Another annular groove 98 is formed within groove 96 at the lower end thereof. Groove 98 is the same depth as groove 86 and is located directly above the same to form an upward continuation thereof. Groove 98 terminates at its upper end in a frusto-conical surface 100.

The upper edge of tubing hanger 24 is at the same level as the top end of tubing head 20. Adapter flange 32 closely overlies the top edge of tubing hanger 24 and forms a joint therewith which is generally designated by numeral 102. Joint 102 is located between the inside surfaces of hanger 24 and flange 32 and is circular in shape. Adapter flange 32 is recessed in the portion thereof which overlies hanger 24 so that a small annular chamber 104 is formed at joint 102 inside of seal 92.

A seal ring 106 is received partially within groove 86 and partially within groove 98 to seal joint 102 from the inside. Ring 106 is preferably formed of a metal such as stainless steel or the like which engages joint 102 and the adjacent surfaces of hanger 24 and flange 32 to provide a metal-to-metal seal at joint 102. Seal ring 106 is thickened at its midpoint to provide a crowned surface 108 located at joint 102. Ring 106 exerts outward pressure on the surfaces of grooves 86 and 98 to provide a fluid-tight seal which prevents leakage of even high pressure well fluids.

In accordance with the present invention, a hollow cylindrical sleeve 110 is included in the wellhead assembly to provide for the testing of seal ring 106. Sleeve 110 is a metal member and is externally threaded at its lower end in order to mate with threads 90 in a threaded connection with tubing hanger 24. The lower portion of sleeve 110 is received in groove 82, while the upper portion of the sleeve is received in groove 96. Sleeve 110 is substantially the same length as the combined lengths of grooves 82 and 96, and the bottom end of the sleeve contacts surface 84 at the bottom of groove 82. Sleeve 110 has a cylindrical inside surface 112 which is a machined surface having the same diameter as surfaces 52, 54, and 94 to provide a continuous cylindrical bore or flow passage for well fluids. Such passage is uniform in diameter (except for threads 56) to avoid presenting any abrupt size changes in the flow passage which directs the well fluids upwardly to the flow control valves of the Christmas tree. The top end of sleeve 110 has a series of cutouts 113 which are adapted to receive a suitable tool for handling of the sleeve.

Sleeve 110 is spaced inwardly of the inside surface of seal ring 106 to present a test chamber 114 between the sleeve and seal ring at a location inside of joint 102. Below chamber 114, sleeve 110 carries a pair of annular seal elements 116 which are received in spaced apart grooves formed in the outside surface of the sleeve. Seal elements 116 are T-shaped in cross-section and tightly engage the surface of groove 82 to provide a fluid-tight seal between the sleeve and tubing hanger 24. An identical pair of annular seal elements 118 are carried in grooves formed in sleeve 110 at a location above chamber 114. Seal elements 118 are T-shaped in cross-section and engage the surface of groove 96 to provide a fluid-tight seal between the sleeve and adapter flange 32. Test chamber 114 is thus bounded at the outside by seal ring 106, at the inside by sleeve 110, at the bottom by the lower pair of seal elements 116, and at the top by the upper pair of seal elements 118.

A fluid test passage 120 is formed to extend through flange 32. The outer end of passage 120 connects with a threaded port 122 on the exterior surface of adapter flange 32, and the inner end of passage 120 leads to surface 100 and thus communicates with chamber 114 to deliver pressurized test fluid thereto for the purpose of testing seal 106. Port 122 is threaded in order to connect with a fitting (not shown) which may be of conventional construction for applying pressurized hydraulic fluid through passage 120 to chamber 114. Another test passage 124 is formed through flange 32. A threaded port 126 formed on the exterior surface of flange 32 connects with the outer end of passage 124 and is suitable for receiving a fitting (not shown) which may be used to apply pressurized hydraulic test fluid to the passage. The inner end of passage 124 connects with chamber 104 in order to deliver pressurized test fluid thereto. Chamber 104 is sealed at the inside by ring 106, at the outside by seal 92 (and packing 80), and at the bottom by seal element 66.

When the well is in production, the metal seals 62 and 106 serve as primary seals which prevent leakage of even the highest pressure well fluids. The softer elastomeric seals 66 and 92 are secondary seals which serve as backup seals in the event of failure or leakage of the primary seals. It is particularly important for the metal seal ring 106 to provide an effective seal in order to maintain the secondary or backup seal 92 isolated from the high pressure well fluids. Accordingly, it is important to thoroughly test seal ring 106 for leakage before the well is brought into production.

In accordance with the present invention, testing of seal ring 106 is carried out by applying hydraulic fluid, water, or another suitable fluid to passage 120 by means of a fitting connected with port 122. The pressurized test fluid is supplied through passage 120 to test chamber 114, where the fluid pressure is applied to seal ring 106 from a location inside of joint 102. Consequently, ring 106 is exposed to fluid pressure from the inside in the same manner as occurs during actual production of the well. It is contemplated that the test pressure will be at least as high as the pressure of the well, which may be as high as 15,000 psi or even 20,000 psi. If fluid leakage past seal ring 106 is detected during the test, the seal ring should be replaced and the new seal ring should be tested before the well is brought into production.

In much the same fashion, the secondary seal 92 can be tested for leakage by applying hydraulic fluid to passage 124 and thus to chamber 104. Test pressure applied to chamber 104 also serves to test seal ring 106 from the outside and to test packing 80 and seal ring 66. In the event that there is leakage, a plastic sealing compound can be injected through passage 124 to seal the leak. If seal ring 106 should develop a leak or otherwise become defective during production of the well, plastic sealant can be injected through passage 120 to fill chamber 114 and thus seal the leak. Plastic injected through passage 120 into chamber 114 activates the T-shaped seals 116 and 118 to assist in preventing leakage.

It is again pointed out that the inside surface 112 of sleeve 110 cooperates with surfaces 54 and 94 to provide a continuous, smooth flow passage for the well fluids. This arrangement avoids any abrupt changes in diameter of the flow passage that would make it particularly susceptible to erosion and other damage caused by high pressure well fluid. In addition, the smooth, continuous flow passage through the wellhead is able to readily accommodate the tools which are extended into and out of the well, since there are no abrupt gaps or shoulders to catch on or otherwise interfere with the tools.

What is claimed is:

1. In a wellhead assembly, the combination of:
a tubing head;
a tubing hanger supported in said tubing head for suspending a tubing string;
a hollow tubing head adapter mounted on said tubing head, said adapter closely overlying an upper end portion of said tubing hanger to form a joint therewith;
a metal seal ring engaging said joint in a manner to seal same at a location interiorly of said tubing hanger and adapter;
a sleeve mounted to extend partially within said tubing hanger and partially within said adapter, said sleeve being spaced inwardly of said seal ring;
means for sealing the sleeve with said tubing hanger and adapter to form a substantially fluid-tight chamber between said sleeve and joint inside of the joint; and
a test passage extending in said adapter, said passage having one end adapted to receive pressurized test fluid and another end communicating with said chamber to apply the test fluid thereto for the purpose of testing said seal ring for leakage from the inside of said joint between the sleeve and seal ring.

2. A combination as set forth in claim 1, including a threaded connection mounting said sleeve to said tubing hanger.

3. A combination as set forth in claim 1, wherein:
said tubing hanger has an annular groove defined in an inside surface thereof adjacent said joint;
said tubing head adapter has an annular groove defined in an inside surface thereof adjacent said joint; and
said metal seal ring is located partially within the groove of said hanger and partially within the groove of said adapter to space the seal ring outwardly of said sleeve.

4. A combination as set forth in claim 3, wherein said means for sealing the sleeve comprises:
an upper pair of annular seal elements carried by said sleeve and sealing against said adapter at a location above the groove thereof; and
a lower pair of annular seal elements carried by said sleeve and sealing against said tubing hanger at a location below the groove thereof.

5. A combination as set forth in claim 1, wherein said tubing hanger, sleeve and adapter have interior surfaces cooperating to form a continuous cylindrical bore of substantially uniform diameter, said bore being in communication with the tubing string to receive well fluids therefrom.

6. A combination as set forth in claim 1, wherein:
said tubing hanger has an inside surface presenting an annular groove sized to receive a lower portion of said sleeve;
said adapter has an inside surface presenting an annular groove sized to receive an upper portion of said sleeve;
said sleeve is mounted partially in the groove of said tubing hanger and partially in the groove of said adapter; and
said hanger, sleeve and adapter have interior surfaces cooperating to form a continuous cylindrical bore of substantially uniform diameter which communicates with the tubing string to receive well fluids therefrom.

7. A combination as set forth in claim 6, wherein:
said inside surface of the tubing hanger has a second annular groove defined therein at a location within the first mentioned groove thereof and adjacent said joint;
said inside surface of the adapter has a second annular groove defined therein at a location within the first mentioned groove thereof and adjacent said joint; and
said metal seal ring is located partially in the second groove of said tubing hanger and partially in the second groove of said adapter to space the seal ring outwardly of said sleeve.

8. A combination as set forth in claim 1, including:
a secondary seal ring providing a seal between said adapter and tubing head at a location spaced outwardly of said metal seal ring;
a second fluid-tight chamber defined between said metal and secondary seal rings; and
a second test passage extending in said adapter, said second passage having one end adapted to receive pressurized test fluid and another end communicating with said second chamber to apply the test fluid thereto for the purpose of testing for leakage.

9. In a wellhead assembly of the type having a tubing head, a tubing hanger supported in the tubing head, a hollow flanged member mounted on the tubing head at a location to form a joint with the tubing hanger, and a seal ring providing a seal at said joint, a seal testing arrangement comprising:
a sleeve mounted within said tubing hanger and flanged member at a location spaced inwardly of said joint between the hanger and flanged member;
means providing spaced apart seals of said sleeve with said flanged member and with said tubing hanger respectively above and below said joint to define a substantially fluid-tight chamber inwardly of said joint and adjacent thereto; and a test passage extending in said flanged member from the exterior thereof to said chamber to direct pressurized test fluid to the chamber for the purpose of testing said seal ring for leakage from the inside of said joint.

10. The invention of claim 9, wherein said tubing hanger, sleeve and flanged member cooperate to present a continuous interior flow passage for well fluids, said flow passage being cylindrical and having a substantially uniform diameter.

11. In a wellhead assembly, the combination of:

a hollow tubing head having a flange on a top end thereof;

a tubing hanger supported in said tubing head and adapted to suspend a tubing string in the well, said tubing hanger presenting an inside surface;

a tubing head adapter mounted on top of said tubing head and having a flange surmounting the flange of said tubing head, said adapter having an inside surface located above the inside surface of said tubing hanger to form a joint therewith;

a metal seal ring mounted at said joint to seal the same from the inside;

a sleeve mounted a spaced distance inwardly of said seal ring in extension within said tubing hanger and adapter, said sleeve having an inside surface cooperating with the inside surface of said hanger and adapter to form a coontinuous cylindrical flow passage for well fluids having a substantially uniform diameter; and means for sealing said sleeve to the inside surface of said adapter at a location above said joint and to the inside surface of said tubing hanger at a location below said joint to define a substantially fluid-tight chamber inside of the joint between said seal ring and sleeve, said chamber being adapted to receive pressurized test fluid applied thereto for the purpose of testing said seal ring for leakage from inside of said joint.

* * * * *